United States Patent [19]

Belanger

[11] Patent Number: 5,022,100

[45] Date of Patent: Jun. 11, 1991

[54] APPARATUS AND METHOD FOR UNDERWATER ACOUSTIC RECEIVING SYSTEM INSTALLATION IN DIVING HELMET

[75] Inventor: Normand Belanger, Tiverton, R.I.

[73] Assignee: The United States of America as represented by the Secretary of the Navy, Washington, D.C.

[21] Appl. No.: 590,266

[22] Filed: Sep. 28, 1990

[51] Int. Cl.[5] ..... A42B 1/24

[52] U.S. Cl. ..... 2/422; 2/2.1 R; 128/201.27; 381/188; 381/205; 367/131; 367/141

[58] Field of Search ..... 2/2.1 R, 422; 128/201.29, 201.27; 381/187, 188, 189, 205; 367/131, 141

[56] References Cited

U.S. PATENT DOCUMENTS

| | | | |
|---|---|---|---|
| 518,959 | 5/1894 | Kolbassieff | 381/187 |
| 1,209,224 | 12/1916 | Stelzner | 2/410 |
| 2,388,674 | 11/1945 | Browne | 2/2.1 R |
| 2,937,244 | 5/1960 | Weinger | 381/187 |
| 3,292,618 | 12/1966 | Davis et al. | 128/201.27 |
| 3,504,984 | 4/1970 | Bush | 2/2.1 R |
| 3,562,451 | 2/1971 | Mullen, Jr. et al. | 381/187 |
| 3,845,768 | 11/1974 | Garrahan | 2/2.1 R |
| 3,958,275 | 5/1976 | Morgan et al. | 2/2.1 R |

*Primary Examiner*—Werner H. Schroeder
*Assistant Examiner*—Michael A. Neas
*Attorney, Agent, or Firm*—Michael J. McGowan; Prithvi C. Lall; Michael F. Oglo

[57] ABSTRACT

An apparatus and method are provided for an underwater acoustic receiving system installation in a deep-sea diving helmet. The present invention is directed to a modification of a diving helmet of the type having mixed gas blanking caps for use with miniature hand-held sonar systems operating at depths of 200 feet or more. The invention provides electrical interconnection of an external sonar receiving system to an internal earphone located near the diver's head in the helmet. The invention permits quick connection and disconnection of wiring outside and inside the helmet without breaking water and pressure seals.

15 Claims, 2 Drawing Sheets

APPARATUS AND METHOD FOR UNDERWATER ACOUSTIC RECEIVING SYSTEM INSTALLATION IN DIVING HELMET

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to wired transmissions systems, and more particularly to an underwater acoustic receiving system installation in a diving helmet.

(2) Description of the Prior Art

Acoustic receiving systems are commonly employed by the Navy in underwater reconnaissance, studies of submerged vessels, and other oceanographic concerns. A miniature sonar receiving system, typically referred to as a "pinger", is used by divers for locating torpedoes or other underwater devices in which transmitters are installed. The transmitters emit an acoustical signal which is received by the pinger receiver, amplified, sent through insulated electrical wires, and reproduced as an audible beep by an earphone located near the diver's ear.

The extreme underwater environments in which such operations occur prohibit convenient and extended utilization of acoustic receiving equipment in even the most routine of applications. For example, reconnaissance operations frequently take place at depths of up to two hundred feet and more. At such depths pressure may exceed 44 pounds per square inch. Where such operations are conducted throughout the year, the diver must assail the water during winter months in which water temperatures can dip as low as 29 degrees Fahrenheit. The present operating procedure for underwater reconnaissance operations using an acoustic receiver system involves use of an earphone attached to the diver's head, with lead wires extending down an underwater garment sleeve and under the cuff to the hand-held pinger receiver. This practice tends to allow water leakage into the dry suit and to thus subvert the whole purpose of using the helmet in combination with a dry suit, and results in the diver's underwater exposure being limited to ten or fifteen minute intervals in many cases. The present procedure of attaching the earphone to the diver's head is also unsatisfactory because the holding strap tends to slip down over the diver's eyes, obstructing his vision, or interfering with the separate communications speaker, which is connected through air cables to the dive boat.

Moreover, the haphazard location of wires from the acoustic receiving system interferes with the diver's use of certain deep-sea diving helmets, such as the Navy MK-12 helmet used by the U.S. Navy. Diving helmets such as these are necessarily compact because of their heavy brass construction and require the diver to move his head in order to view objects that are not located directly in front of him.

In view of the foregoing difficulties, a modification is needed for providing installation of an underwater acoustic receiver system in a deep-sea diving helmet, so as to improve the level of safety to the diver and to permit convenient use of such a system for reasonable periods of time in harsh underwater environments.

SUMMARY OF THE INVENTION

In surmounting the difficulties and limitations described above, the present invention provides an apparatus and method for the installation of an underwater acoustic receiving system in a diving helmet. The Navy MK-12 helmet, manufactured by Morse Diving Equipment, Rockland, Mass., is the only diving helmet approved by the United States Navy. The helmet is made of brass and is heavily constructed to withstand the pressures associated with deep-sea diving; the integral structure of the helmet therefore does not freely allow modification. The present invention includes modifying a mixed gas blanking cap on the MK-12 helmet to receive a neoprene receptacle, which is an Electro Oceanics Receptacle 59F2 or the like, to permit wires to pass through an opening without admitting water into the dry suit or helmet or acting as a pressure leak in either. Mixed gas blanking caps on the helmet are also made of brass. Mounting the neoprene receptacle on the cap permits the removal of the acoustic receiver system from the helmet without the need for extensive remodification to the helmet. The neoprene receptacle also provides for convenient disconnection of the pinger receiver from the helmet without breaking the pressure seal within the helmet. This provides several advantages in the event of emergencies. For example, a pinger receiver may be quickly disconnected if a diver experiences trouble that requires that he be placed immediately into a Recompression Chamber. The diver may also want to remove the pinger receiver, which tends to float and move around in the underwater environment, when he or she needs to locate a torpedo or work on sensitive equipment.

The wires from the neoprene receptacle run through chambers within the helmet, out of the diver's way, to connect with an earphone Model H878/6 992 manufactured by the Electro-Voice Earphone Corporation. The earphone is mounted on a strip of Velcro near the diver's ear, and does not interfere with the earphone which is used for communications purposes and which is connected through air cables to the support boat above the diver. The wires to the earphone contain interconnects to permit the wiring assembly to be quickly removed from the helmet.

The neoprene receptacle is mounted in the mixed gas blanking cap in a manner which prevents leakage of water under pressure. A hole is bored through the cap to permit the neoprene receptacle to be mounted onto and to extend partially through to the underside of the cap, where it is fastened by a washer and nut. It is also recommended to tap the hole so that the connector can be screw-threaded into the hole as a further safety measure. Scratching of the cap cover is to be avoided at all costs when the hole is bored and tapped in the cap for receiving the 59F2 neoprene receptacle. Scratches may lead to potential leakage at high pressure. The method for insuring that the surface of the mixed gas blanking cap remains smooth during the boring and tapping of the hole is to place contact paper or other protective film over the cap prior to undertaking any mechanical alterations, and then to remove the paper or film once the hole is bored and tapped. An otherwise unprotected cap is highly susceptible to scratching from marking devices, drill bits, and machining taps. Additionally, the receptacle must be prevented from turning when the washer and nut are tightened on the underside of the cap. This precaution is to ensure proper seating of the neoprene receptacle and to prevent leakage once the helmet is subjected to increased pressure levels.

BRIEF DESCRIPTION OF THE DRAWINGS

A more complete understanding of the present invention and the attendant advantages and features thereof will be more readily understood by reference to the following detailed description, when considered in conjunction with the accompanying drawings, where.

DETAILED DESCRIPTION OF THE INVENTION

Figure 1:
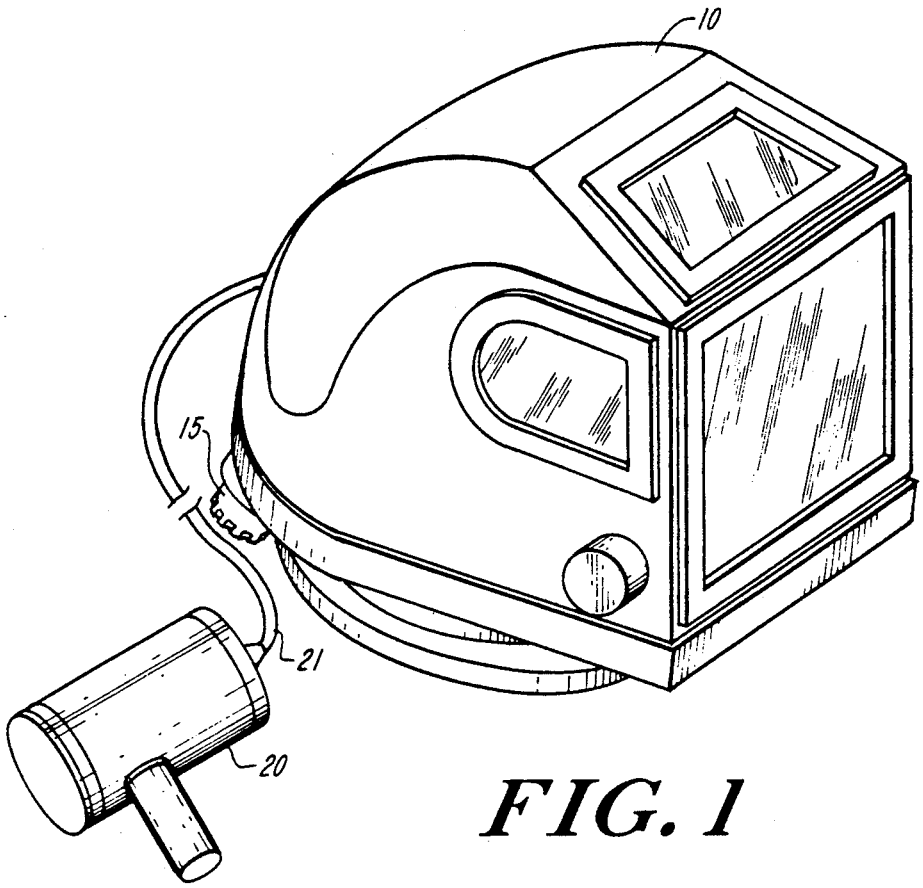
FIG. 1 is a perspective external view of a Navy MK-12 diving helmet connected to an acoustic receiver.
Figure 2:
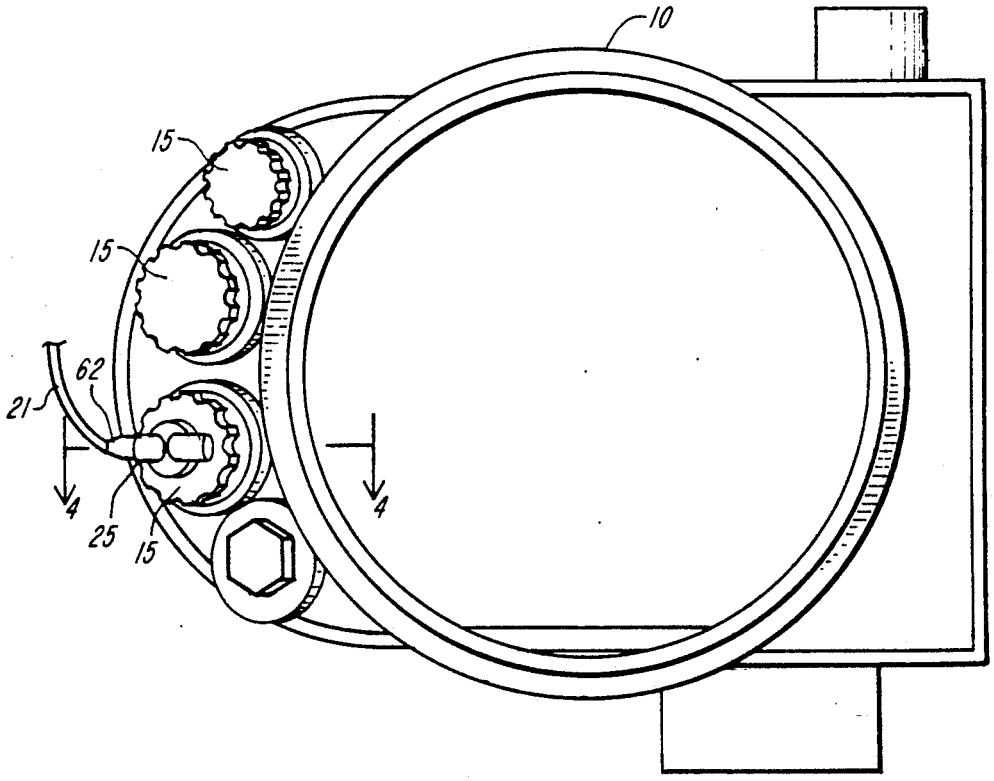
FIG. 2 is a bottom view of a MK-12 helmet with a wire connected to the top of a mixed gas blanking cap.
Figure 3:
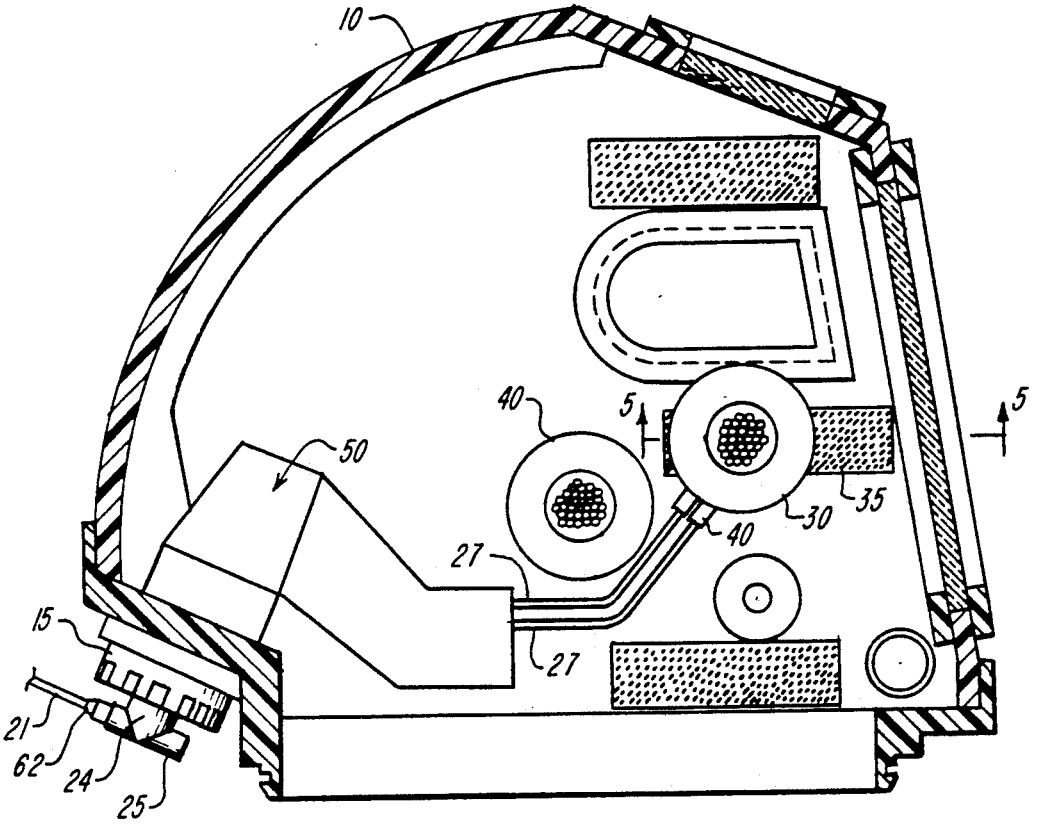
FIG. 3 is a partial cross-section view of a MK-12 helmet showing a wire connected to a neoprene receptacle on the mixed gas blanking cap which is connected to a chamber inside the helmet from which wires connect to an earphone.
Figure 4:
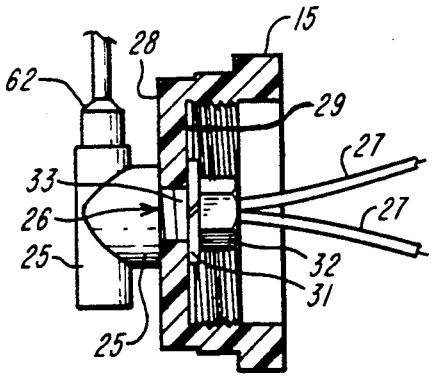
FIG. 4 is a partial section side view of the neoprene receptacle mounted through a hole in the mixed gas blanking cap and having wire leads.
Figure 5:
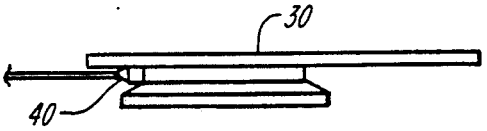
FIG. 5 is a side view of the earphone of the present invention.
Figure 6:
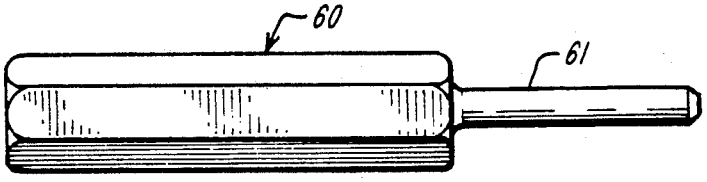
FIG. 6 is a side view of a device for installing the neoprene receptacle in a hole bored in a mixed gas blanking cap.

Referring now to the drawings contained in FIGS. 1–6 wherein like numerals designate corresponding or similar elements throughout the several views, there is shown a Navy MK-12 diving helmet 10 on which mixed gas blanking caps 15 are mounted. The installation of the acoustic receiving system requires that cable from the acoustic-locator or "pinger" receiver 20 be cabled as at 21 to a Model 59F2 Electro Oceanics Receptacle 25 (sometimes referred to in the industry as an "EO Receptacle") which is connected to the mixed gas blanking cap 15. Receptacle 25 shown in FIG. 2, is typically made of neoprene, permits an electrical connection from external cable 21 from the pinger receiver 20 to internal wires 27, shown in FIG. 3, leading to the earphone 30. Earphone 30 is preferably a model H878/6 992 earphone manufactured by the Electro-Voice Earphone Corporation. The receptacle 25 has a generally T-shape and comprises an external female plug for accepting a male plug from the pinger receiver and a solid member 24 for containing embedded wires 27 from the external female plug. Receptacle 25 provides a watertight and pressure resistant seal around the wires 27 which are led by the solid member 24 into the helmet 10. A male plug from the external pinger receiver 20 purges water from the female plug, the location of which is generally indicated at 62, on the neoprene receptacle 25 to permit an electrical connection to be achieved therebetween without short-circuiting by water. Neoprene receptacle 25 and earphone 30 are officially approved for diving helmet use by the U.S. Navy.

The acoustic receiver system earphone 30 is mounted on a VELCRO strip 35 attached to the inner helmet wall next to the diver's ear and next to the other earphone 42 which is used for the general communications system. Interconnects 40 between the internal wires 27 and the acoustic receiver system earphone 30 provide quick plugging and unplugging of the earphone and removal of the system from the helmet 10. The internal wiring 27 is run through chambers generally designated at 50 within the helmet 10 and are connected to the mixed gas blanking cap 15. The wires are thereby kept out of the diver's way and prevented from interfering with communication system wires (not shown) and with internal helmet padding (not shown).

The T-shaped neoprene connector/receptacle 25 or "waterproof connector" is mounted in the mixed gas blanking cap 15 through a screw-threaded hole generally designated 26 which is drilled and tapped from the outside surface 28 of the cap 15 into the inner (or underside) surface 29 of the cap 15. The waterproof connector 25 has a screw-threaded end 33 upon which a washer 31 and nut 32 are fastened to secure the waterproof connector 25 to the cap 15. To insure that the "cover" or outer surface 28 of the mixed gas blanking cap 15 remains unscratched, contact paper is placed over the outside surface 28 of the cap 15 before drilling and tapping, then removed once the hole 26 is made. The waterproof connector 25 is screw-threaded and sealed onto the cap 15. While the washer 31 and nut 32 are tightened on the screw-thread end 33 of the T-shaped waterproof connector 25, an installation tool, generally designated 60, having a post end 61 conformed to be received by the female plug-receptacle generally designated 62 may be inserted into the female plug receptacle 62 located in the waterproof connector 25 and the threaded portion of the receptacle tightened therewith. The waterproof connector 25 is a self-purging unit which allows plugging or unplugging of transmission wiring 21 while the diver is underwater. These waterproof connectors 25 prevent water and pressure leakage at increased pressure levels.

The method of installing the acoustic receiving system includes preparing the outerside 28 of the mixed gas blanking cap 15. Cap 25 is removed from the helmet 10, and contact paper or other removable film is applied to the outerside 28 of the cap 15. The hole 26 is bored and tapped, using conventional machining methods, from the outerside 28 to the underside 29. In the present embodiment of the invention, it is desired to use Protex protective paper manufactured by the Mask-off Company in Montoria, Calif. The contact paper or other removable film is then removed from the cap outerside 28, which should be unscratched. A scratched cap should not be used, because leakage around the connector 25 where it contacts surface 28 may ensue at increased water pressure levels. The T-shaped neoprene connecter 25 has a screw-threaded end 33 which must be carefully screwed into the bored hole 26 and the shoulder of end 33 firmly seated against surface 28. A washer 31 and then a nut 32 are placed on the screw thread end 33 of the connector 25 inserted through hole 26, washer 31 seating against the underside 29 of the cap 15. The connector 25 must be prevented from turning while the nut 32 is tightened. This is done by holding the T-shaped receptacle. It may also be done, as in the preferred manner, by using an oblong holding tool 60 having a holding end 61 which is conformed to and placed into the female plug-receptacle generally located at 62 on the T-shaped connector 25.

Many modifications of the presently disclosed invention will become apparent to those skilled in the art without departing from the scope of the instant invention.

What is claimed is:

1. A method for installing an underwater acoustic receiving system in a diving helmet having at least one mixed gas blanking cap, said at least one cap having an outerside and an underside, comprising the steps of:

boring a hole from said cap outerside through to said cap underside without scratching said cap outerside;

placing a waterproof connector, having a screw-threaded seat end mounting said connector to the outerside of said cap, into and partially through said bored hole to said underside of said mixed gas blanking cap and providing therewith a watertight seal around said bored hole;

placing a washer, then a nut, respectively, onto said screw-threaded seat end; and preventing said waterproof connector from twisting on said outerside of said cap while tightening said nut on said screw-threaded seat end.

2. The method of claim 1 wherein the boring of said hole in said mixed gas blanking cap is preceded by the step of removably affixing a protective film on said outer side of said cap to prevent scratching said outerside of said cap.

3. The method of claim 1 wherein said waterproof connector placed into and partially through said bored hole is made of neoprene.

4. The method of claim 1 wherein said waterproof connector placed into and partially through said bored hole generally has a T-shape.

5. The method of claim 1 wherein said waterproof connector is prevented from twisting during tightening of said nut by using an oblong holding tool for increasing resistance to relative motion of the cap.

6. The method of claim 1 wherein said step of boring said hole is followed by tapping into said cap screw-threads conformed to said screw-thread seat end on said waterproof connector.

7. An underwater acoustic receiving system installation in a diving helmet, comprising:

an underwater diving helmet having at least one removable mixed gas blanking cap, said at least one cap having an outerside and an underside, said at least one cap further having a hole extending from said outerside through to said underside;

a waterproof connector mounted in and positioned partially through said hole to said underside of said mixed gas blanking cap, said waterproof connector comprising, a solid member having a seat for mounting said waterproof connector onto said outerside of said cap and providing therewith a watertight seal around said hole, a female plug-receptacle fixedly mounted in a portion of said solid member and having at least two prepositioned contacts for electrically interconnecting with a male plug from an acoustic receiving system, said female plug-receptacle conformed to said male plug such that the insertion of said male plug expels water from said female plug-receptacle, at least two wires electrically connected to corresponding contacts in said female plug-receptacle and embedded in said solid member from said electrical connection at said plug-receptacle through said solid member of said receptacle located on said underside of said cap; and an earphone electrically connected to said at least two wires.

8. The underwater acoustic receiving system installation of claim 6 wherein said waterproof connector seated in said hole is made of neoprene.

9. The underwater acoustic receiving system installation of claim 7 wherein said waterproof receptacle generally has a T-shape.

10. The underwater acoustic receiving system installation of claim 7 further comprising hook and loop type fasteners within said helmet for removably mounting said earphone.

11. The underwater acoustic receiving system installation of claim 7 wherein the portion of said waterproof connector positioned through said hole to said underside of said mixed gas blanking cap has a screw-thread end for allowing a nut to be used to secure said waterproof connector to said cap.

12. The underwater acoustic receiving system installation of claim 7 wherein said hole extending from said outerside of said cap through to said underside of said cap has screw threads corresponding to said screw threads located on said waterproof connector.

13. The underwater acoustic receiving system installation of claim 11 wherein said waterproof connector is secured to said mixed gas blanking cap by a washer and nut on said underside of said cap.

14. The underwater acoustic receiving system installation of claim 11 wherein said female plug-receptacle permits disconnection of said male plug.

15. The underwater acoustic receiving system installation of claim 11 wherein said earphone may be disconnected from said at least two wires to allow removal of said earphone from within said helmet.

* * * * *